US009194581B2

(12) United States Patent
Clark

(10) Patent No.: US 9,194,581 B2
(45) Date of Patent: Nov. 24, 2015

(54) BURNER AND PILOT PROTECTOR FOR HORIZONTAL FLAMMABILITY TEST CHAMBER

(75) Inventor: Kevin Lawrence Clark, Pinckney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1048 days.

(21) Appl. No.: 13/232,417

(22) Filed: Sep. 14, 2011

(65) Prior Publication Data

US 2013/0065188 A1 Mar. 14, 2013

(51) Int. Cl.
*F23D 14/76* (2006.01)
*F23D 14/78* (2006.01)
*F23D 14/84* (2006.01)

(52) U.S. Cl.
CPC ..... *F23D 14/76* (2013.01); *F23D 14/78* (2013.01); *F23D 14/84* (2013.01)

(58) Field of Classification Search
CPC ..... F23D 14/76
See application file for complete search history.

(56) References Cited

U.S. PATENT DOCUMENTS 632,615 A 9/1899 Alexander
658,491 A 9/1900 Sibbelt
703,809 A * 7/1902 Nagengast ..... 431/292
809,111 A * 1/1906 Jenkins ..... 431/119
930,592 A * 8/1909 Cohn ..... 431/294
1,052,239 A 2/1913 Genthner
1,194,385 A 8/1916 Hoover
1,316,624 A * 9/1919 Lucas ..... 431/294
1,349,785 A 8/1920 Savage
1,654,403 A * 12/1927 Blake ..... 431/117
1,975,192 A * 10/1934 Chadwick et al. ..... 431/122
2,559,527 A * 7/1951 Williams ..... 239/288.3
2,833,201 A * 5/1958 Simank ..... 99/481
2,980,178 A 4/1961 Sears
3,289,730 A * 12/1966 Elmy ..... 239/523
3,413,911 A * 12/1968 Phelan et al. ..... 99/355
4,095,936 A 6/1978 Godijn
4,150,610 A * 4/1979 Ferrara ..... 99/419

(Continued)

OTHER PUBLICATIONS

United States Consumer Product Safety Commission "Laboratory Test Manual for 16 CFR part 1610: Standard for the Flammability of Clothing Textiles" Oct. 2008.*

(Continued)

*Primary Examiner* — Gregory Huson
*Assistant Examiner* — Martha Becton
(74) *Attorney, Agent, or Firm* — Dinsmore & Shohl LLP

(57) ABSTRACT

A burner shield (100) for use in a horizontal flammability test chamber (102) is a planar member (120) that contains a stop (126) and a bend (128). A first area (120A) is defined as the area of the planar member (120) between the proximate end (124) and the stop (126), limited to the area of planar member 120 inside chamber 102 by stop 126. The first area (120A) of planar member (120) is inserted through an aperture on chamber (102) so that a substantial portion of first area (120A) covers burner (104) within chamber (102) so that the top surface of first area (120A) accumulates any byproduct (130) and/or prevents it from entering burner (104). The bend (128) is angled downward relative to the horizontal axis of the first area (120A) such that a distal end (122) is substantially aligned with the stop (126) and the distal end (122) abuts or rests against the outside portion of test chamber (102) to stabilize and support burner shield (100) during testing.

12 Claims, 3 Drawing Sheets

(56) References Cited

U.S. PATENT DOCUMENTS

| | | | | |
|---|---|---|---|---|
| 4,334,462 | A | 6/1982 | Hefling | |
| 4,585,410 | A * | 4/1986 | Baker et al. | 431/350 |
| 5,308,046 | A | 5/1994 | Coble | |
| 5,473,980 | A | 12/1995 | Carpenter | |
| 5,879,152 | A * | 3/1999 | Griffel | 431/293 |
| 6,098,953 | A * | 8/2000 | Machado | 249/93 |
| 6,536,729 | B1 * | 3/2003 | Haddock | 248/300 |
| 6,536,943 | B1 | 3/2003 | Feske | |
| 6,557,544 | B2 * | 5/2003 | Sim | 126/25 A |
| 6,945,159 | B2 * | 9/2005 | Lee | 99/357 |
| 6,966,100 | B2 * | 11/2005 | Sonne | 16/110.1 |
| 8,136,311 | B2 * | 3/2012 | Liu | 52/173.3 |
| 2003/0213378 | A1 * | 11/2003 | Farrow | 99/450 |
| 2010/0307074 | A1 * | 12/2010 | Stearns et al. | 52/173.1 |

OTHER PUBLICATIONS

Sunspot "Horizontal Flammbiility Text Equipment" Mar. 4, 2010.*

* cited by examiner

BURNER AND PILOT PROTECTOR FOR HORIZONTAL FLAMMABILITY TEST CHAMBER

FIELD OF THE INVENTION

The invention relates to a burner shield for use with a horizontal flammability test chamber and more specifically, a burner shield that protects the pilot and burner tubes in a horizontal flammability test chamber from burning test material during the operation of the horizontal flammability test chamber.

BACKGROUND OF THE INVENTION

Flammability is the measure of how readily something will burn or ignite. Flammability testing of different materials in a flammability chamber helps quantify the flammability of these materials. Many industries conduct regular flammability testing on materials they use in their products.

Some of the byproducts produced by the combustion of test materials can cause damage to the test chamber. Incomplete combustion of plastics and composites often produces a melted byproduct that flows like a liquid during the combustion process, yet solidifies when the specimen stops burning. Normally, the test chamber must be thoroughly cleaned after testing to remove the byproducts produced during a flammability test before another test can be performed. Heretofore, the burning test material has melted onto anything including the test chamber floor and the burner and pilot tubes. Test technicians may obviate the cleaning of the chamber floor by using aluminum foil to line and protect the floor from the melted byproduct, but protecting the burner and pilot tubes from melting material has not been as easy or convenient. The burner tube and pilot tube are largely unprotected from melting material which often enters both tubes, with the material solidifying shortly thereafter and clogging the tubes. The fine dimensions of both the burner and pilot tubes require care and precision when disassembling, cleaning and maintaining the tubes. Cleaning the tubes is very time consuming which causes a large amount of down time between tests.

Given the variety of materials that make up many products, separate tests on each material must be performed before the product as a whole can be approved for sale in the market. The down time associated with the cleaning of a flammability test chamber limits the amount of testing one can perform, which in turn can increase the time it takes to bring the overall product to market. As global competition grows, time delays associated with the cleaning of a test chamber can be costly for product suppliers and manufacturers.

Therefore, it is desirable to have a burner shield which is designed to be easily insertable into the flammability chamber between the short time after the burner flame is extinguished and prior to the test material melting to protect both the burner and pilot tubes from the ingress of melting test materials.

It is further desirable to have a burner shield which does not affect a standardized test procedure, yet protects the burner and pilot tubes from damage caused by melting test materials produced during flammability testing.

It is further desirable to have a burner shield that is easily manufactured and of low cost to the consumer that can be retro-fitted onto current horizontal flammability test chambers for both ease of use and for purposes of cost savings.

SUMMARY OF THE INVENTION

The invention is directed towards a burner shield for use in a horizontal flammability test chamber. In one aspect, there is disclosed a burner shield with a planar member that is inserted through an aperture on the flammability test chamber immediately after the burner flame is extinguished, such that melted byproduct produced by the combustion of test material is not allowed to fall or flow into the burner and pilot tubes in the course of flammability testing. The burner shield also includes a stop disposed on an axis through the planar member to limit the lateral movement of the burner shield through the aperture into the flammability chamber.

DETAILED DESCRIPTION OF THE INVENTION

Figure 1:
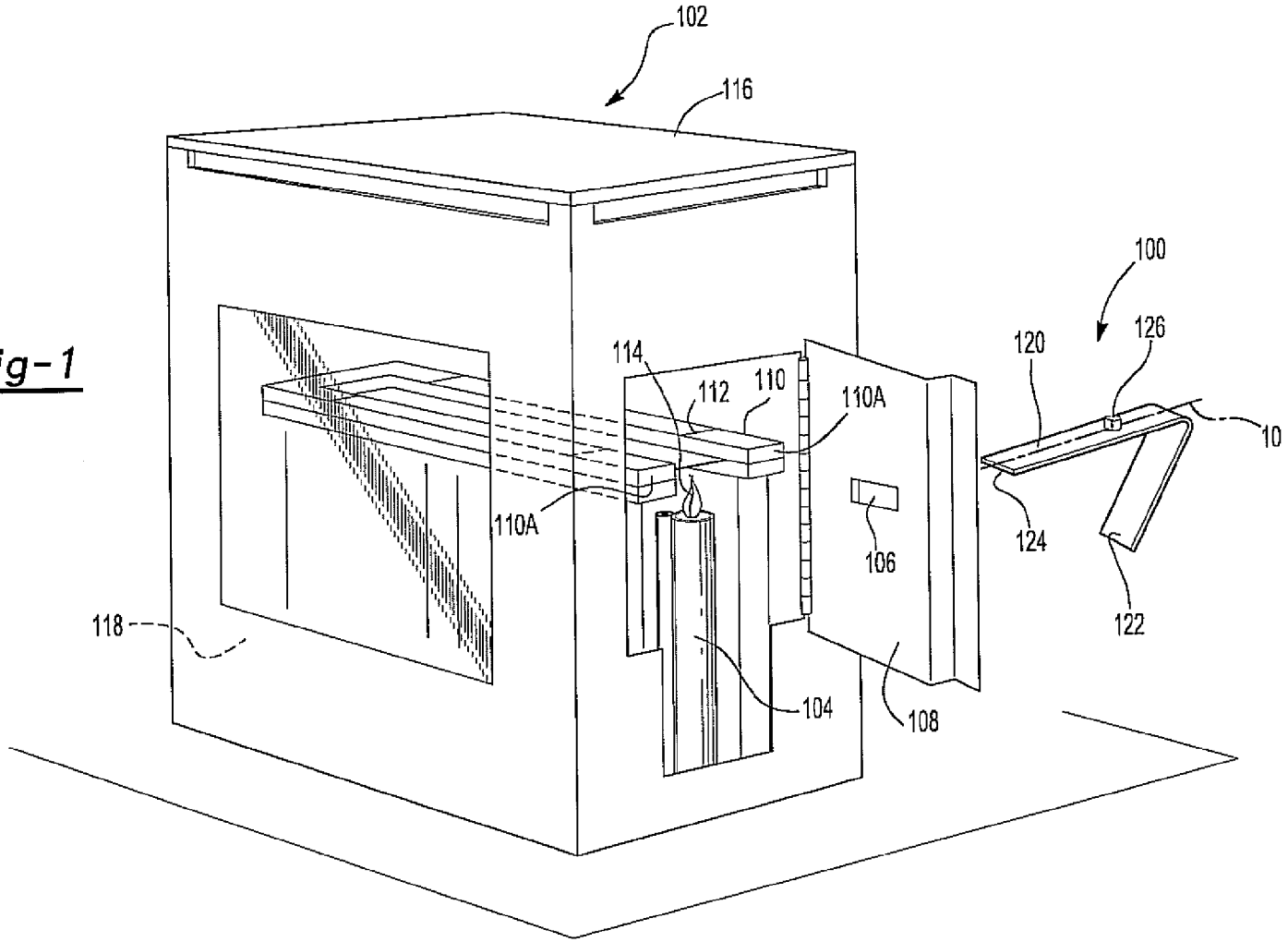
FIG. 1 is a perspective view of a horizontal flammability test chamber and a preferred embodiment of the burner shield.

As used throughout the specification, the terms flammability chamber, test chamber and test cabinet may all be used interchangeably to reference and describe a horizontal flammability test chamber. Material or specimen, and their equivalents, may be used interchangeably to reference and describe the material to be tested in the flammability chamber. Burning material, melted material, combustion byproduct, or byproduct, and their equivalents, may all refer to the byproduct produced by the combustion of test material during flammability testing. Burner, tube, burner tube, burner and pilot tubes, tubes, and their equivalents, may be used interchangeably to reference and describe the burner/pilot tube assembly which is not limited to a burner/pilot tube combination, but may also refer to a burner tube without the pilot tube. Terms such as 'in use', 'test', 'testing', 'operation' and their equivalents, may be used interchangeably to reference and describe the act of using the flammability chamber to test the flammability of materials.

While not limiting the scope of the invention in any way, horizontal flammability test chambers, as specified by standard FMV SS 302 and its equivalents, comprise a heat resistant, non-corrodible metal test chamber with the specific dimensions of 381 mm length, 203 mm depth, and 356 mm height, with a top portion, a floor, and four sidewalls. Some horizontal flammability test chambers have a removable top for convenient access to the interior of the test chamber, A 13 mm air gap is provided around the top of the sidewalls and below the top portion for ventilation. A heat resistant glass viewing window is disposed along the length, or longest side wall, of the flammability chamber to comprise the front wall of the test chamber, while the wall running the length opposite to the front wall comprises the back wall section of the chamber. The sidewall portions disposed immediately adjacent to the front wall, constitute the two end walls of the flammability test chamber.

Typically, a door is disposed on the right end wall relative to the front of the flammability chamber for access to the chamber interior. However, the door is not limited to this end wall and may be disposed on the opposite end wall in lieu of its typical placement. A 19 mm diameter hole is typically placed toward the center bottom on the end wall opposite the door to provide a gas line, which acts as a conduit to provide a liquefied gas which is ignited to operate the burner.

The floor of the test chamber has 10 holes measuring 19 mm in diameter placed at specified locations for ventilation and legs are mounted on the exterior floor/bottom section of the test chamber so that the exterior floor portion of the test chamber is 10 mm from the surface on which the test chamber is placed. The 10 mm air gap provided by the legs also facilitates ventilation.

The burner tube of a bunsen burner disposed within the test chamber has a diameter of 10 mm and is specified as 38 mm in height by FMV SS 302, but is not limited to this height by other test standards. Pilot tubes typically accompany the burner tube for ease of burner operation and to facilitate automated ignition and timing of the burner. The burner is not fixedly mounted to the floor of the test chamber. As such, the burner may be free standing on the test chamber floor or attached on the interior of the door, such that by opening the door, the burner is removed from the test chamber and is set in position upon closing of the door.

The material to be tested can be inserted between two identical U-shaped metal frames 25 mm wide and 10 mm high with interior dimensions 51 mm wide and 330 mm long. In addition, the frames can be made from a chrome or nickel-plated metal that is non-corroding and can structurally withstand the temperatures within the test chamber. However, the frame is not limited to these types of metals and other metals having these properties may be substituted.

An open end of the frame is defined by an open area relative to the U-shape (i.e. the one end of the frame without metal). The U-shape frame is held by supports inside the test cabinet and scribe lines are provided on the vertical, viewable surfaces of the frames at prescribed distances to assist in the measuring and the timing of the burn rates of test materials.

Material to be tested can be cut into a rectangle 102 mm wide and 356 mm long and is no more than 13 mm in thickness. Thereafter, the rectangular test sample is placed between the two metal frames. However, it should be appreciated that other test standards describe alternate procedures for materials outside the range of these dimensions. The two U-shaped metal frames with the test material disposed in between is referred to herein as a U-frame assembly.

The exact position of the burner is not specified by the standards, but burner placement must be such that the center of the burner is placed directly below the center of the test specimen on the open end of the U-frame assembly. Thus, it is advantageous to mount the material for testing in the U-shaped frame such that the open end of the frame and the burner are both disposed closest to the door in order to align the elements prior to testing.

Referring now to FIG. 1, a burner shield is shown generally at 100 for use during material flammability testing in a horizontal flammability test chamber shown generally at 102. Test chamber 102 can have a burner 104 with flame 114 disposed within.

Figure 2:
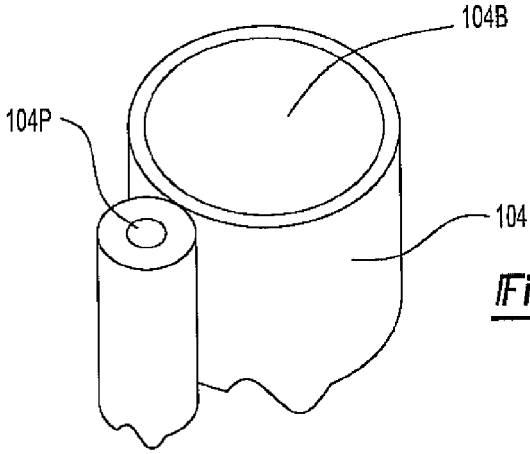
FIG. 2 is a top view of the burner showing both the burner tube and pilot tube.

Referring now to FIG. 2, the top of burner 104 shows burner tube 104B with pilot tube 104P constituting a burner/pilot tube assembly.

Preferably, an aperture 106 is disposed in door 108 of test chamber 102 to allow the insertion of the burner shield 100. In the alternative, the aperture 106 and may be located anywhere on test chamber 102 such that the shield 100 may be inserted to protect and/or cover the burner 104 from melting material byproduct 130 [shown in FIG. 6] during the operation of test chamber 102. Preferably, the aperture 106 is placed in such a position that allows for easy and convenient insertion of burner shield 100 during the appropriate time of the test procedure and at such a height that burner shield 100 is either in direct contact with the top of burner 104 as to form a complete seal and thereby preventing the ingress of unwanted byproducts of material combustion 130 or is located at a height close enough to the burner 104 such that excess material that accumulates may fall over the sides of burner shield 100 and is prevented from entering burner 104.

Burner shield 100 can be a planar member 120 with a distal end 122 and a proximate end 124. A stop 126 can be disposed through an axis 10 of planar member 120 to limit the lateral movement of planar member 120 through aperture 106 into test chamber 102. As such, stop 126 allows some portion of planar member 120 to pass through aperture 106 into test chamber 102, but prevents planar member 120 from being completely pushed through aperture 106 and falling into test chamber 102. Pushing planar member 120 through aperture 106 to the extent allowed by stop 126 will ensure that an adequate portion 120A of planar member 120 will cover burner 104.

Figure 3:
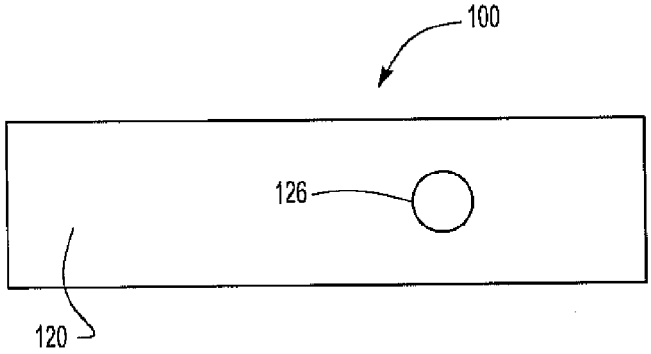
FIG. 3 is a top view of one embodiment of the burner shield.

Referring now to FIG. 3, in its simplest embodiment, the planar member 120 of burner shield 100 is rectangular in shape and is fabricated to such a dimension to allow it to both pass through aperture 106 and cover the burner 104 sufficiently to prevent melted byproduct from entering and clogging burner 104 during flammability testing. Stop 126 is preferably disposed on a vertical axis through planar member 120, but the placement of stop 126 is not limited to this axis. Planar member 120 is also preferably inserted substantially horizontally through aperture 106, though it is not limited to this orientation and may be inserted on a diagonal or inserted vertically, for example through the top 116 of test chamber 102.

Figure 4:
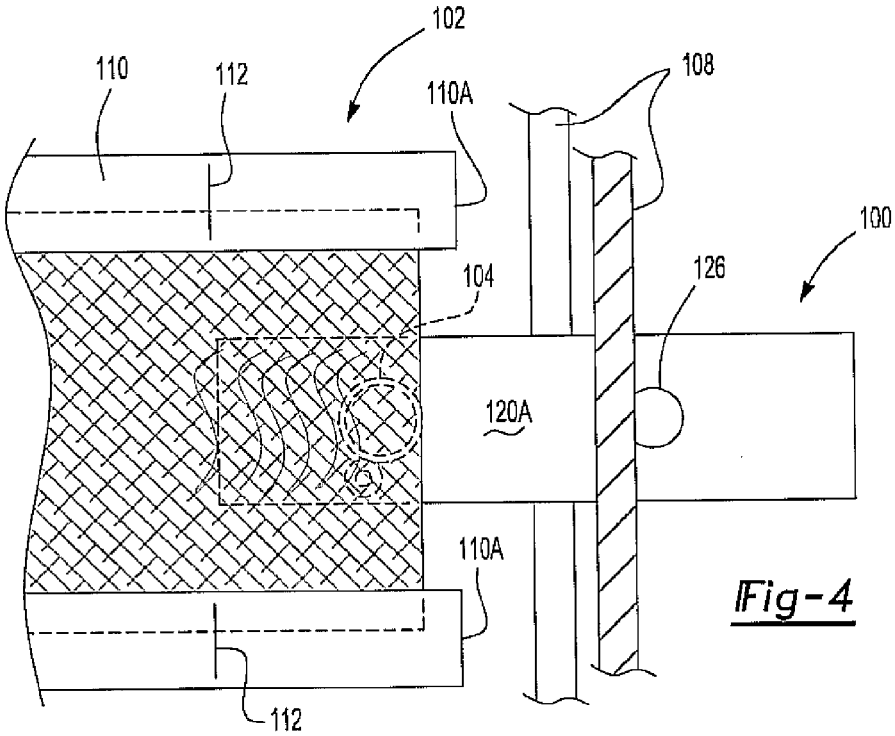
FIG. 4 is a top view of one embodiment of the burner shield in use in the test chamber.

Referring now to FIG. 4, preferably, stop 126 is located on burner shield 100 to limit the lateral movement of planar member 120 into the test chamber 102 such that the first area 120A does not extend past a first scribe line 112 on the open end 110A-110A of the U-shaped frame assembly 110.

Figures 5, 6, 7:
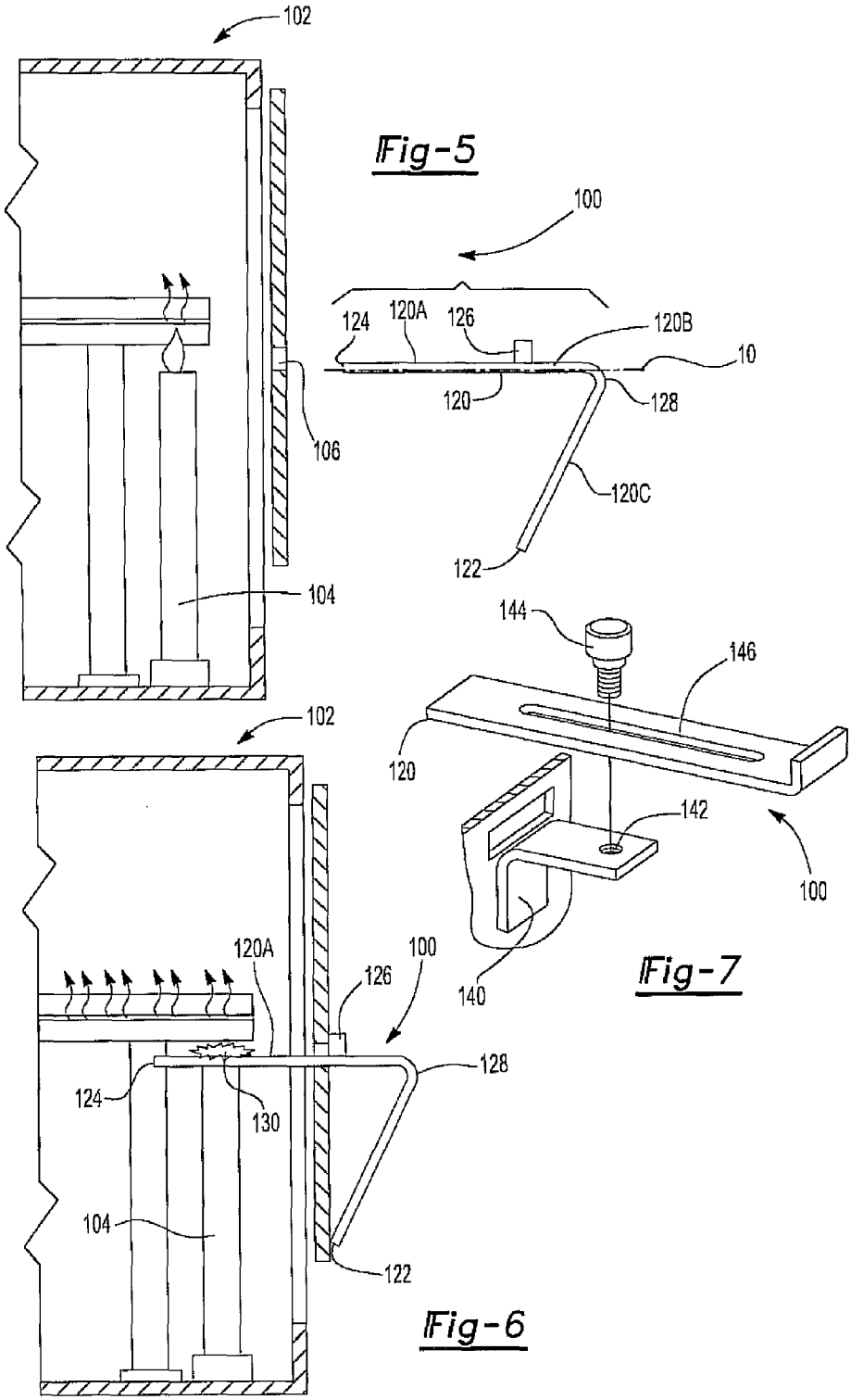
FIG. 5 is a cross-sectional view of the test chamber with the preferred embodiment of the invention at the start of flammability testing.
FIG. 6 is a cross-sectional view of the test chamber with the preferred embodiment in use at some time 15 seconds after the start of flammability testing.
FIG. 7 is an alternate embodiment of a burner shield for use in horizontal flammability testing.

Referring now to FIG. 5, a preferred embodiment of burner shield 100 is shown. In this embodiment, planar member 120 contains bend 128, relative, but not limited to the axis 10 of planar member 120. Bend 128 along with stop 126 help to define first, second and third areas of planar member 120 labeled 120A, 120B and 120C respectively. The first area 120A is defined as the area of the planar member 120 between proximate end 124 and the stop 126, limited to the area of planar member 120 inside chamber 102 by stop 126. The second area 120B is defined as the area of planar member 120 between stop 126 and bend 128. The third area 120C is defined as the area of planar member 120 between the bend 128 and distal end 122.

Referring now to FIG. 6, bend 128 is preferably angled downward relative to the horizontal axis 10 of first and second areas 120A and 120B such that distal end 122 is substantially aligned with stop 126 and distal end 122 abuts or rests against the outside portion of test chamber 102 to stabilize and support burner shield 100 to stabilize burner shield 100 during testing. A substantial portion of first area 120A is used to cover burner 104 within chamber 102 so that the top surface of first area 120A accumulates any byproduct 130 to prevent it from entering burner 104.

Notably, the size and dimensions of burner shield 100 are not limiting, as the first area 120A of burner shield 100 need only be of such dimension to either prevent the ingress of melted test material byproduct 130 into burner 104 or accumulate test material byproduct 130, such that the top surface of first area 120A accumulates and holds enough of the test material byproduct 130 until the end of testing whereby the burner 104 can either be removed from test chamber 102, or until such a time that the byproduct 130 solidifies and is no longer fluid enough to move from the top surface of first area 120A into burner 104.

Burner shield 100 is preferably constructed from a fire-proof material, preferably a metal that is both structurally capable of withstanding the temperature within test chamber 102 during flammability testing and is a metal that is non-corroding. However, the material of burner shield 100 is not limited to these materials.

Referring now to FIG. 7, an alternative embodiment of a burner shield 100 is shown. Instead of a completely removable burner shield shown in the other embodiments, planar member 120 is semi-fixedly attached via bracket 140 and a screw 144. Screw 144 may double as a stop, although this is not necessary. Movement of planar member 120 into the test chamber can be limited by tightening screw 144 which attaches to hole 142 on bracket 140. Planar member 120 has channel 146 disposed longitudinally along its length, through which screw 144 passes through to attach to hole 142 on bracket 140. While bracket 140 is attached immediately under aperture 106 on the test chamber as shown in FIG. 7, it is not necessarily limited to being mounted in this position and may comprise any other shape, mount or location in keeping with the spirit and scope of the illustrated embodiment.

Other embodiments (not shown) in the scope and spirit of disclosed burner shield 100 may be possible. Such embodiments may include, but are not limited to: automating the burner shield 100 to automatically move into the preferred position described in the embodiments above immediately after the extinguishing of flame 114 on burner 104 to protect burner 104 from melting material; coating areas 120B and 120C of burner shield 100 with an insulating material that limits the transfer of heat, such that burner shield 100 may be more easily handled after flammability testing; varying the size of aperture 106 to allow a first area 120A of different design (i.e. bowl or crucible) to better accumulate melted byproduct while at the same time enlarging stop 126 to both limit lateral movement of burner shield 100 into test chamber 102 and effectively sealing aperture 106 to prevent the ingress of air into test chamber 102 during testing which may cause unintended test variability; a capping device in first area 120A in the exact size and shape of the top tube of burner 104, which would be inserted through aperture 106 to effectively seal burner 104 to prevent the ingress of test byproducts; as well as other variations to the shape and size of the burner shield 100 and aperture 106 which do not depart from prescribed testing standards, etc.

Although a presentation of the preferred embodiment(s) has been described, it is for illustrative purposes only. The words used herein are descriptive rather than of limitative form.

I claim:

1. A horizontal flammability chamber with a burner shield comprising:

a flammability chamber having a door with an outer surface;

a burner shield in the form of a planar member with a distal end, a proximate end, a stop disposed on a vertical axis through the planar member to limit lateral movement of the planar member into the flammability chamber, and a bend about a horizontal axis of the planar member;

the bend and the stop defining first, second and third areas of the planar member, the first area being the planar member between the proximate end and the stop, the second area being the planar member between the stop and the bend, and the third area being the planar member between the bend and the distal end;

the bend being located between the stop and the distal end, and the third area being angled downwards about the bend relative to the horizontal axis of the planar member and aligning the distal end of the planar member with the vertical axis of the stop; and the distal end of the planar member abutting the outer surface of the flammability chamber to limit movement of the planar member on the vertical axis.

2. The burner shield of claim 1, wherein a portion of the first area of the planar member covers at least a burner and a pilot tube within the flammability chamber and prevents byproduct produced from a test material in the flammability chamber from entering the burner and the pilot tube.

3. The burner shield of claim 1, wherein the proximate end of the planar member is inserted through an aperture in the door of the flammability chamber.

4. The burner shield of claim 3, wherein the aperture is located near a burner and a pilot tube within the flammability chamber.

5. The burner shield of claim 3, wherein the stop is located on the planar member at a location that limits lateral movement of the first area of the planar member into the flammability chamber to an extent before a first scribed line of a u-shaped frame of the flammability chamber.

6. The burner shield of claim 1, wherein the planar member is of a fire-proof material.

7. The burner shield of claim 6, wherein the planar member is of a metal capable of structurally withstanding a temperature within the flammability chamber.

8. The burner shield of claim 7, wherein the metal is non-corrodible.

9. The burner shield of claim 1, wherein the stop is a nut and bolt assembly.

10. A horizontal flammability chamber with a burner shield comprising:

a planar member having a distal end and a proximate end;

a stop disposed on a vertical axis through the planar member to limit lateral movement of the planar member into the flammability chamber; and a bend about a horizontal axis of the planar member between the stop and the proximate end;

wherein the bend and the stop define first, second and third areas of the planar member, the first area being the planar member between the proximate end and the stop, the second area being the planar member between the stop and the bend, the third area being the planar member between the bend and the distal end, the bend being located between the stop and the distal end, and the third area being angled downwards about the bend relative to the horizontal axis of the planar member to align the distal end of the planar member with the vertical axis of the stop;

the distal end aligned with the vertical axis of the stop abutting an outer surface of a door of the flammability chamber and limiting movement of the first and second areas of the planar member on the vertical axis;

a portion of the first area of the planar member covering at least a burner and a pilot tube within the flammability chamber and preventing byproduct from a test material from entering the burner and the pilot tube;

the distal end of the horizontal planar member inserted through an aperture in the door of the flammability chamber;

the planar member is of a fire proof material; and the stop is a nut and bolt assembly.

11. The burner shield of claim 10, wherein the aperture is located near the burner and the pilot tube in the door of the flammability chamber.

12. The burner shield of claim 10, wherein the stop is located on the planar member at a location that limits lateral movement of the first area of the planar member into the flammability chamber to an extent before a first scribed line of a u-shaped frame of the flammability chamber.

* * * * *